US009394694B2

(12) United States Patent
Iannelli

(10) Patent No.: US 9,394,694 B2
(45) Date of Patent: Jul. 19, 2016

(54) GUTTER COVER SYSTEM

(71) Applicant: Anthony M. Iannelli, Cincinnati, OH (US)

(72) Inventor: Anthony M. Iannelli, Cincinnati, OH (US)

( * ) Notice: Subject to any disclaimer, the term of this patent is extended or adjusted under 35 U.S.C. 154(b) by 0 days.

(21) Appl. No.: 14/333,905

(22) Filed: Jul. 17, 2014

(65) Prior Publication Data

US 2015/0020462 A1 Jan. 22, 2015

Related U.S. Application Data

(60) Provisional application No. 61/847,779, filed on Jul. 18, 2013.

(51) Int. Cl.
*E04D 13/064* (2006.01)
*E04D 13/072* (2006.01)
*E04D 13/076* (2006.01)

(52) U.S. Cl.
CPC ..... *E04D 13/064* (2013.01); *E04D 13/076* (2013.01); *E04D 13/0727* (2013.01)

(58) Field of Classification Search
CPC .. E04D 13/064; E04D 13/0727; E04D 13/076
USPC ..... 52/11, 12, 15, 16, 58; 210/162, 170.03, 210/474; 248/48.1, 48.2, 312.1
See application file for complete search history.

(56) References Cited

U.S. PATENT DOCUMENTS 3,150,851 A 9/1964 Richie et al.
3,426,987 A * 2/1969 Leslie ..... 248/48.2
3,612,453 A * 10/1971 Zimmer ..... 248/48.2
3,667,177 A * 6/1972 Biela ..... 52/278
3,752,428 A * 8/1973 Trostle et al. ..... 248/48.2
4,241,548 A * 12/1980 Rowe ..... 52/11
4,393,629 A * 7/1983 Gasparini et al. ..... 52/74
4,461,128 A * 7/1984 Knoebl ..... 52/94
4,888,920 A * 12/1989 Marulic ..... 52/12
4,937,986 A * 7/1990 Way et al. ..... 52/12
4,941,299 A * 7/1990 Sweers ..... 52/12
5,060,439 A * 10/1991 Clements et al. ..... 52/396.07

(Continued)

FOREIGN PATENT DOCUMENTS

| | | |
|---|---|---|
| CA | 2086480 | 2/1994 |
| DE | 4304138 | 2/1994 |
| GB | 2488434 | 8/2012 |

OTHER PUBLICATIONS

European Search Report and Written Opinion dated Nov. 19, 2014 for Application No. EP 14177683.

*Primary Examiner* — James Ference
(74) *Attorney, Agent, or Firm* — Frost Brown Todd LLC

(57) ABSTRACT

A gutter cover system (5) for a gutter comprises a bracket (10) and a cover section. The bracket (10) comprises an anchoring plate (11) and a receptacle (12) comprising a barb slot. The cover section (50) comprises a top portion (60) that extends forwardly from a rear edge (70) of the cover section, a front wall (80) extending downwardly from the top portion, and a ledge (90) extending generally horizontally in front of the front wall. The receptacle (12) is configured to receive the rear edge (70) of the cover section. The rear edge (70) of the cover section (50) comprises the barb connector. The gutter cover system (5) may be installed by attaching the anchoring plate (11) of the bracket (10) to the fascia board of a house or the rear wall of a gutter, followed by inserting the barb connector (71) of the cover section (50) into the receptacle (12).

20 Claims, 6 Drawing Sheets

(56) References Cited

U.S. PATENT DOCUMENTS

| | | | | | |
|---|---|---|---|---|---|
| 5,098,045 | A * | 3/1992 | Pepper | 248/48.2 |
| 5,216,852 | A * | 6/1993 | Bemis et al. | 52/12 |
| 5,375,379 | A * | 12/1994 | Meckstroth | 52/12 |
| 5,406,756 | A * | 4/1995 | Bemis et al. | 52/16 |
| 5,519,969 | A * | 5/1996 | Golba | 52/60 |
| 5,619,825 | A * | 4/1997 | Leroney et al. | 52/12 |
| 5,640,809 | A * | 6/1997 | Iannelli | 52/12 |
| 5,660,001 | A * | 8/1997 | Albracht | 52/12 |
| 5,862,631 | A * | 1/1999 | Attaway et al. | 52/11 |
| 5,960,591 | A * | 10/1999 | Schluter | 52/11 |
| 6,098,344 | A * | 8/2000 | Albracht | 52/12 |
| 6,134,843 | A * | 10/2000 | Tregear | 52/12 |
| 6,138,418 | A * | 10/2000 | Dyer et al. | 52/94 |
| 6,161,338 | A * | 12/2000 | Kuhns | 52/12 |
| 6,367,743 | B1 * | 4/2002 | Iannelli | 248/48.2 |
| 6,625,941 | B2 * | 9/2003 | Shaw | 52/211 |
| 6,701,674 | B1 * | 3/2004 | Albracht | 52/12 |
| 6,735,907 | B2 * | 5/2004 | Stevens | 52/12 |
| 6,745,516 | B2 * | 6/2004 | Beyers | 52/12 |
| 6,904,718 | B2 * | 6/2005 | Fox | 52/12 |
| 6,944,991 | B2 * | 9/2005 | Kim | 52/11 |
| 6,968,651 | B2 * | 11/2005 | Bergeron | 52/12 |
| 7,143,549 | B2 * | 12/2006 | Brochu | 52/12 |
| 7,581,356 | B1 * | 9/2009 | Balkum et al. | 52/12 |
| 7,610,722 | B1 * | 11/2009 | Carroll | 52/16 |
| 7,650,720 | B2 * | 1/2010 | Ealer, Sr. | 52/12 |
| 7,658,036 | B2 * | 2/2010 | Banks et al. | 52/12 |
| 7,730,672 | B2 * | 6/2010 | Knudson et al. | 52/12 |
| 7,765,742 | B2 * | 8/2010 | Ealer, Sr. | 52/12 |
| 7,891,142 | B1 * | 2/2011 | Ealer, Sr. | 52/12 |
| 7,950,187 | B2 * | 5/2011 | Iannelli | 52/11 |
| 8,397,435 | B2 * | 3/2013 | Iannelli | 52/11 |
| 8,397,436 | B2 * | 3/2013 | Higginbotham | 52/12 |
| 8,578,658 | B2 * | 11/2013 | Snell | 52/12 |
| 8,646,218 | B1 * | 2/2014 | Iannelli | 52/12 |
| 2002/0124476 | A1 * | 9/2002 | Iannelli | 52/11 |
| 2003/0110712 | A1 * | 6/2003 | Brochu | 52/12 |
| 2004/0244302 | A1 * | 12/2004 | Neumann | 52/11 |
| 2004/0250478 | A1 * | 12/2004 | McDonald et al. | 52/11 |
| 2005/0005526 | A1 * | 1/2005 | Teed | 52/11 |
| 2005/0172566 | A1 * | 8/2005 | McDonald et al. | 52/12 |
| 2005/0183343 | A1 * | 8/2005 | Jones | 52/11 |
| 2005/0210758 | A1 * | 9/2005 | Iannelli | 52/11 |
| 2005/0235577 | A1 * | 10/2005 | Smith | 52/15 |
| 2005/0257432 | A1 * | 11/2005 | Higginbotham | 52/12 |
| 2006/0080900 | A1 * | 4/2006 | Graham et al. | 52/24 |
| 2006/0101722 | A1 * | 5/2006 | Ealer | 52/12 |
| 2006/0179723 | A1 * | 8/2006 | Robins | 52/11 |
| 2006/0196124 | A1 * | 9/2006 | Bachman | 52/12 |
| 2007/0012845 | A1 * | 1/2007 | Iannelli | 248/312.1 |
| 2007/0044401 | A1 * | 3/2007 | Bonshor | 52/213 |
| 2007/0199249 | A1 * | 8/2007 | Beck et al. | 52/12 |
| 2007/0214730 | A1 * | 9/2007 | Cota | 52/12 |
| 2007/0234647 | A1 * | 10/2007 | Higginbotham | 52/12 |
| 2008/0029654 | A1 * | 2/2008 | Iannelli | 248/48.2 |
| 2008/0120920 | A1 * | 5/2008 | Knudson et al. | 52/12 |
| 2008/0127575 | A1 * | 6/2008 | Ealer | 52/12 |
| 2008/0190040 | A1 * | 8/2008 | Graves | 52/12 |
| 2009/0031638 | A1 * | 2/2009 | Iannelli | 52/12 |
| 2009/0139180 | A1 * | 6/2009 | Kehs et al. | 52/741.3 |
| 2009/0188173 | A1 * | 7/2009 | Ealer, Sr. | 52/12 |
| 2009/0235592 | A1 * | 9/2009 | Knudson et al. | 52/12 |
| 2011/0138697 | A1 * | 6/2011 | Martin | 52/12 |
| 2011/0185641 | A1 * | 8/2011 | Snell | 52/12 |
| 2011/0225898 | A1 * | 9/2011 | Iannelli | 52/12 |
| 2011/0265391 | A1 * | 11/2011 | Robins | 52/12 |
| 2012/0247032 | A1 * | 10/2012 | Lowrie, III | 52/12 |
| 2013/0284650 | A1 * | 10/2013 | Higginbotham | 210/162 |
| 2014/0026494 | A1 * | 1/2014 | Iannelli | 52/12 |

* cited by examiner

GUTTER COVER SYSTEM

CROSS REFERENCE TO RELATED APPLICATIONS

The present application hereby claims the benefit of the provisional patent application of the same title, Ser. No. 61/847,779, filed on Jul. 18, 2013, the disclosure of which is herein incorporated by reference in its entirety.

BACKGROUND

Gutter covers are useful for preventing leaves and other debris from entering rain gutters, particularly during heavy storms. The accumulation of leaves and other debris will cause the rain gutter to clog and prevent water from exiting the gutter properly. The water may overflow and cause erosion beneath the gutter, flood the basement, or even crack the home's foundation.

Homeowners can periodically clean out their gutters by climbing atop the roof or standing on a ladder. As an alternative, products have been created to prevent leaves and other debris from entering the rain gutters, such as gutter covers. These allow water to flow into the gutter but prevent leaves and other debris from doing so by various methods. Unfortunately, many of these covers require modification of the gutter or are difficult to install.

BRIEF SUMMARY

A new gutter cover system can permit the easy installation of the gutter cover. The gutter cover system for a gutter comprises a bracket and a cover section. The bracket comprises an anchoring plate and a receptacle comprising a barb slot. The cover section comprises a top portion that extends forwardly from a rear edge of the cover section, a front wall extending downwardly from the top portion, and a ledge extending generally horizontally in front of the front wall. The receptacle is configured to receive the rear edge of the cover section. The rear edge of the cover section comprises the barb connector.

The gutter cover system may be installed on a gutter by attaching the anchoring plate of the bracket to the fascia board of a house or the rear wall of a gutter. Then inserting the barb connector of the cover section into the receptacle.

These and other objects and advantages shall be made apparent from the accompanying drawings and the description thereof.

BRIEF DESCRIPTION OF THE FIGURES

The accompanying drawings, which are incorporated in and constitute a part of this specification, illustrate embodiments, and together with the general description given above, and the detailed description of the embodiments given below, serve to explain the principles of the present disclosure.

DETAILED DESCRIPTION

Figure 1:
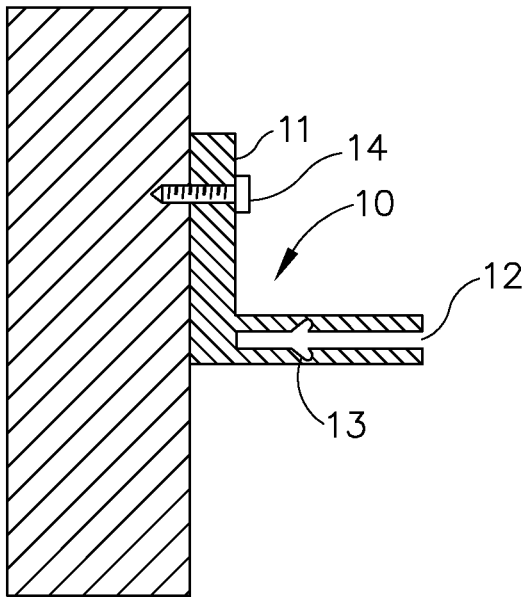
FIG. 1 is a side view of an embodiment of a bracket installed on the fascia board of a house.

A gutter cover system (5) can permit the easy installation of a gutter cover. The gutter cover system (5) for a gutter comprises a bracket (10) and a cover section (50). The bracket (10) comprises an anchoring plate (11) and a receptacle (12) comprising a barb slot (13). The cover section (50) comprises a top portion (60) that extends forwardly from a rear edge (70) of the cover section, a front wall (80) extending downwardly from the top portion (60), and a ledge (90) extending generally horizontally in front of the front wall (80). The receptacle (12) is configured to receive the rear edge (70) of the cover section. The rear edge (70) of the cover section (50) includes a barb connector (71).

The barb connection has two parts: a receptacle (12) on the bracket (10) that comprises a barb slot (13), and the barb connector (71) on the rear edge (70) of the cover section. The rear edge (70) of the cover section (50) slips into the receptacle (12). The barb connector (71) is a flap that folds back against the cover section (50) when the rear edge (70) is inserted into the receptacle (12). It springs back to its original conformation when there is space and catches in the barb slot (13). The barb slot (13) prevents the barb connector (71) from folding against the cover section (50) and holds it so that the rear edge (70) cannot be removed from the receptacle (12).

The barb connection allows the rear edge (70) of the cover section (50) to be secured quickly and easily to the fascia board of a house or the rear wall of a gutter through the bracket (10). It also prevents the removal of the cover section (50).

Figure 2:
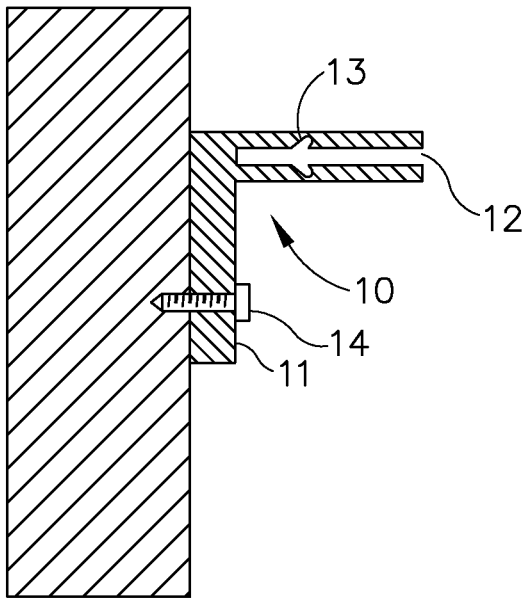
FIG. 2 is a side view of an embodiment of a bracket on the fascia board of a house.
Figure 3:
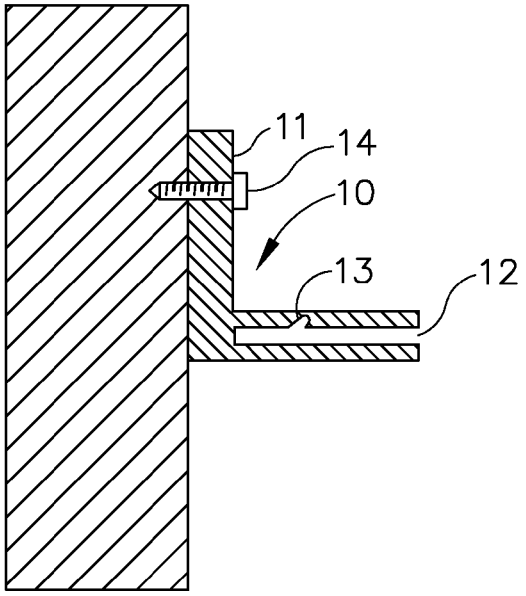
FIG. 3 is a side view of an embodiment of a bracket on the fascia board of a house.

In some embodiments, the receptacle (12) has one barb slot (13), as shown in FIG. 3. In some embodiments, the receptacle (12) has two barb slots (13), as shown in FIGS. 1 and 2. When the receptacle (12) has one barb slot (13), it must be mounted so that the barb slot (13) will accept the barb connector (71). If it is mounted upside down, then the barb connector (71) will not fit into the barb slot (13) and will not lock the cover section (50) into the bracket. When the receptacle (12) has two barb slots, the bracket (10) may be mounted in either of two orientations as shown in FIGS. 1 and 2, because a barb slot (13) will be available to receive the barb connector (71) in either orientation.

The bracket (10) also comprises an anchoring plate (11). A fastener (14) attaches the anchoring plate (11) of the bracket (10) to the fascia board of a house or the rear wall of a gutter. The orientation of the anchoring plate (11) to the receptacle (12) may be at nearly any angle. However, most fascia boards and gutters are configured so that the bracket (10) will work best if the anchoring plate (11) is at approximately a 90 degree angle to the receptacle (12).

The cover section (50) of the gutter cover system (5) is the part of the system that allows water to enter the gutter and prevents leaves and other debris from doing so. It is configures so that it extends longitudinally in overlaying relation to a length of gutter. In some embodiments, the cover section (50) comprises longitudinally extending ridges (61), see FIG. 4, in the top portion (60) of the cover section (50). In some embodiments, the cover section (50) comprises two or more longitudinally extending ridges (61). In some embodiments, the cover section (50) comprises longitudinally extending valleys (62), see FIG. 5. In some embodiments, the cover section (50) comprises two or more longitudinally extending valleys (62).

In some embodiments, the cover section (50) comprises apertures (63). The apertures (63) allow water to enter the gutter while preventing leaves and other debris from doing so. The apertures (63) may be located on different parts of the cover section. In some embodiments there is a first bank of apertures behind the first longitudinally extending ridge and a second bank of apertures in front of the first longitudinally extending ridge. In some embodiments, the average size of the apertures (63) in a bank of apertures that is closer to the rear edge (70) is larger than the average size of the apertures (63) in a bank that is closer to the front of the cover section (50). In some embodiments, the longitudinally extending ridges (61) comprise apertures (63). In some embodiments, the longitudinally extending ridges (61) do not comprise apertures (63). In some embodiments, the longitudinally extending valleys (62) comprise apertures (63). In some embodiments, the longitudinally extending valleys (62) do not comprise apertures.

Figure 4:
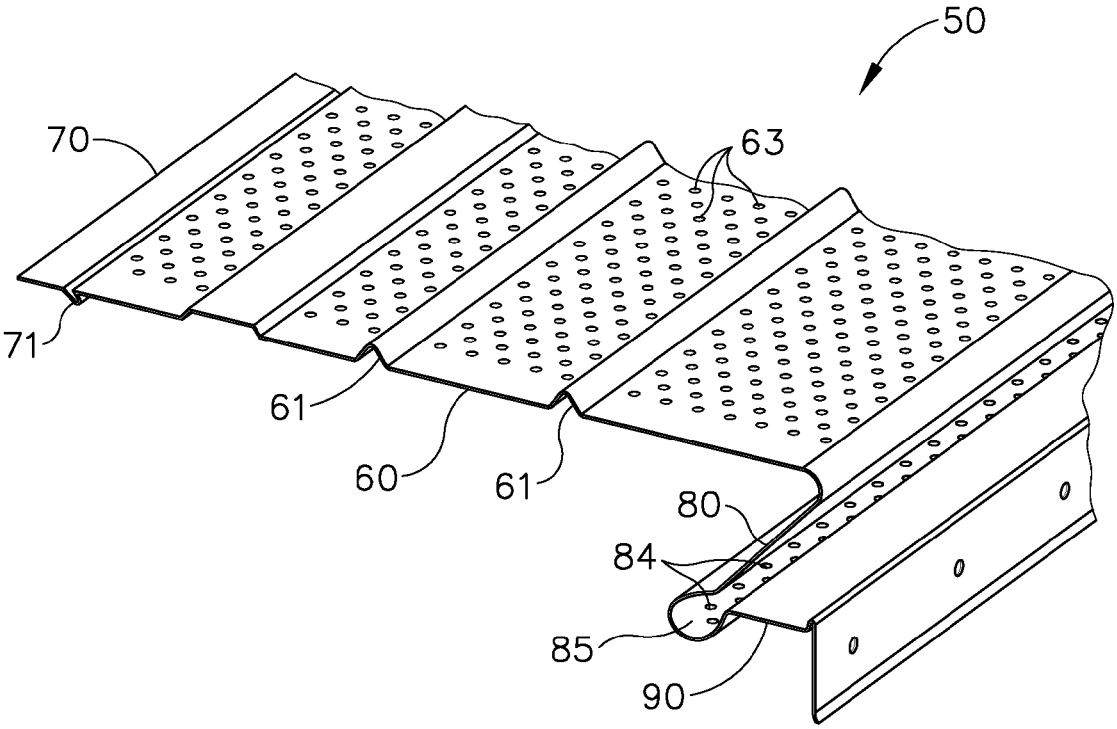
FIG. 4 is a perspective view of an embodiment of a cover section.
Figure 5:
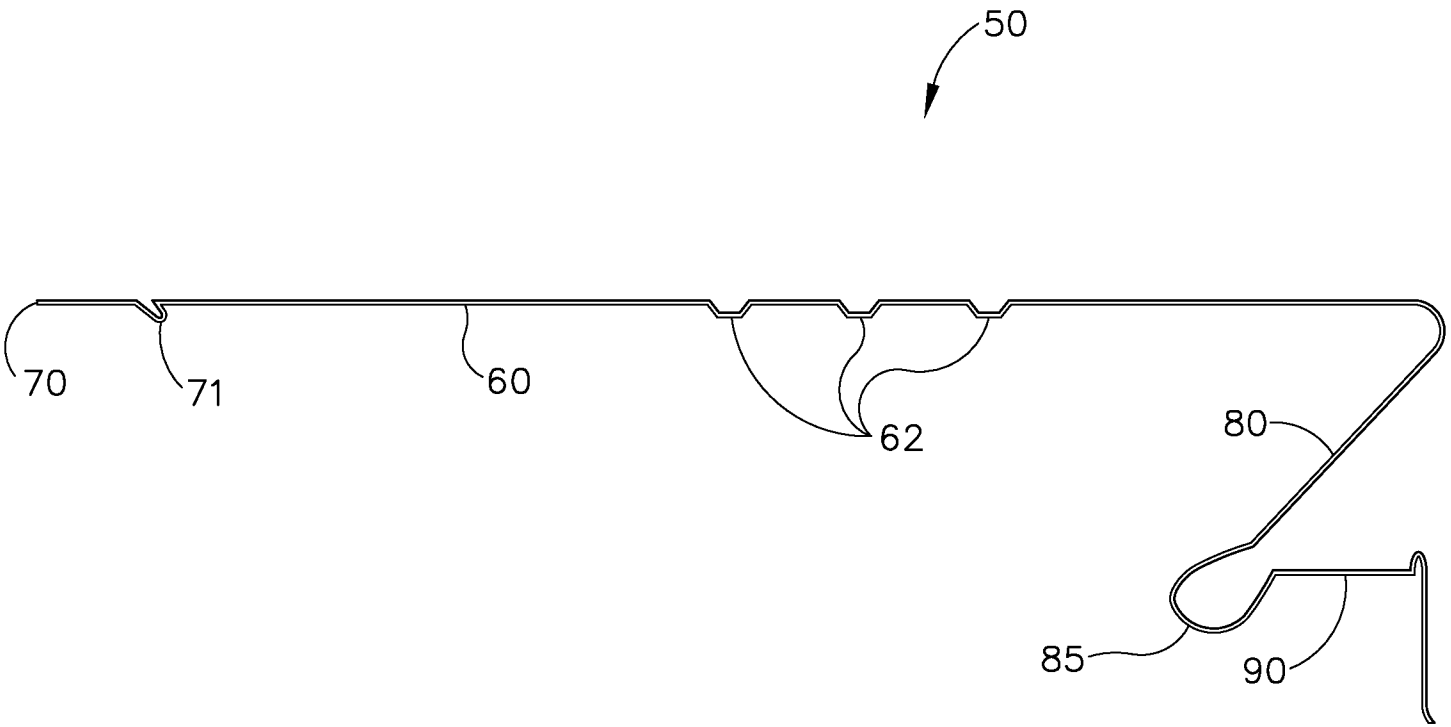
FIG. 5 is a side view of an embodiment of a cover section.
Figure 6:
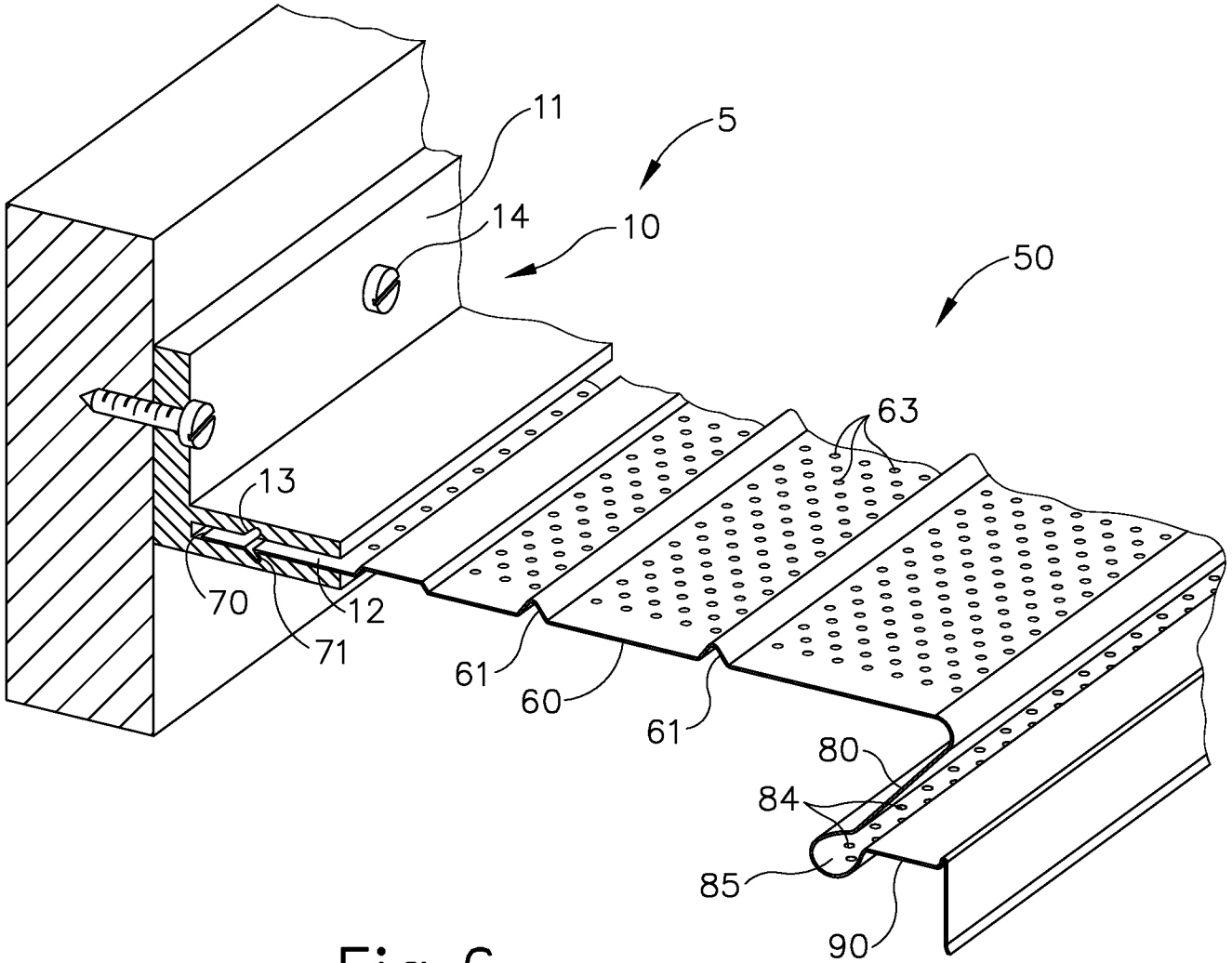
FIG. 6 is a perspective view of an embodiment of a gutter cover system.
Figure 7:
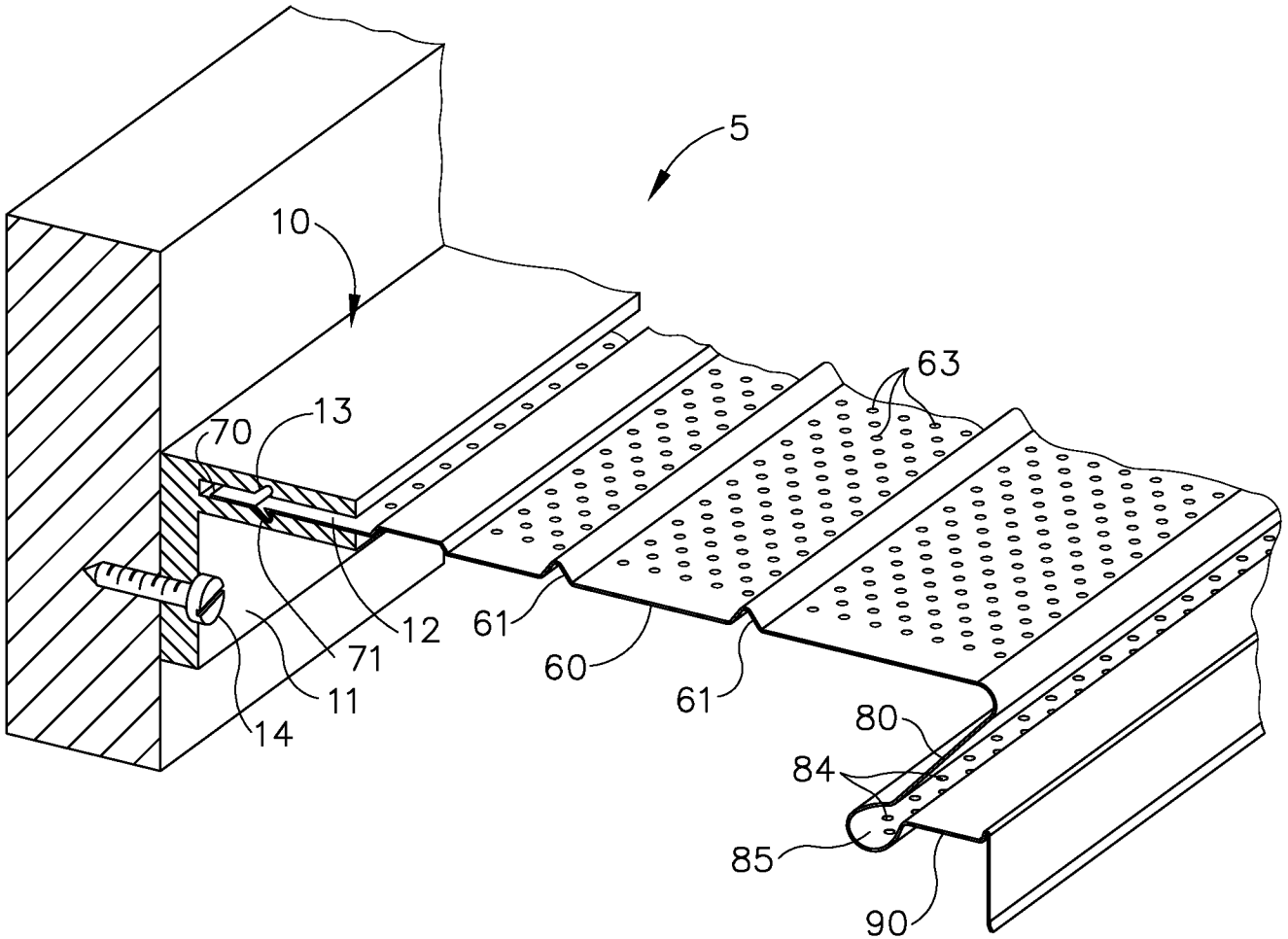
FIG. 7 is a perspective view of an embodiment of a gutter cover system.

In some embodiments, between the front wall (80), that extending downwardly from the top portion (60), and the ledge (90) is a trough (85), as shown in FIGS. 4, 6, and 7. The trough (85) collects water that flows over the top portion (60) and down the front wall (80). The water in the trough (85) can then enter the gutter through apertures (84). The apertures (84) in the trough (85) could be small or large, round, square, rectangular, or any other shape.

Figure 8:
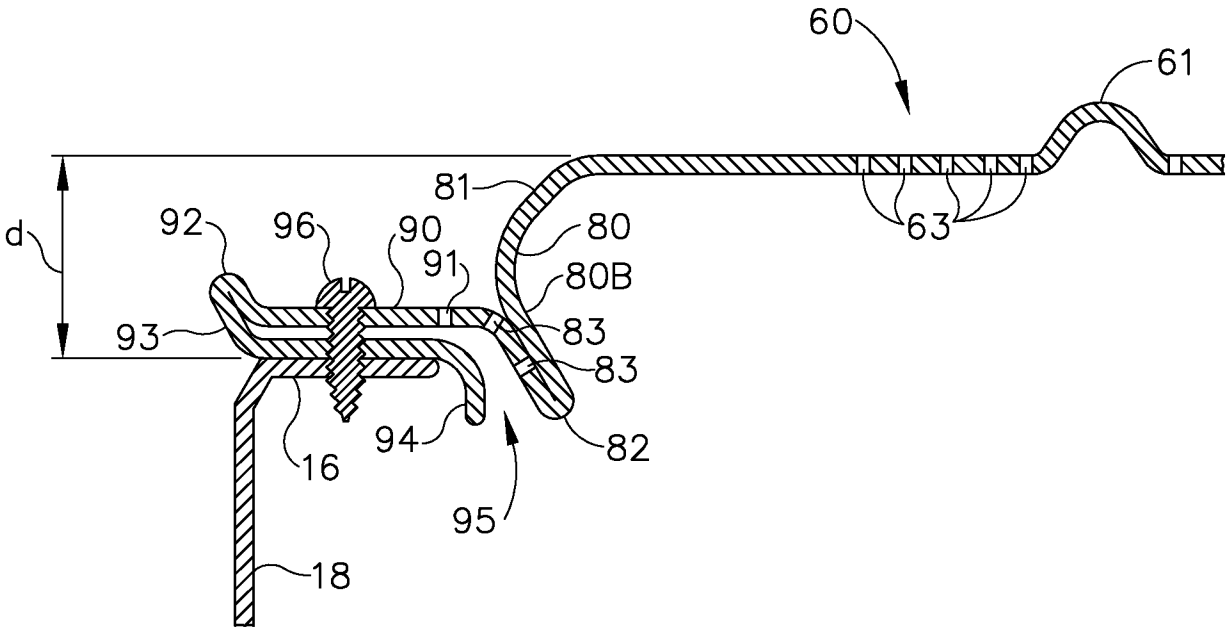
FIG. 8 is a side view of an embodiment of the front section of a cover section.

As shown in FIG. 8, in some embodiments, the front wall (80) comprises a curved nose or inclined ramp (81) extending forwardly and downwardly from the front part of the cover section (50). A lower section (80B) of the front wall (80) may comprise a splashguard (82) extending downwardly and inwardly a distance within a range of 0.8-1.5 cm (0.3-0.5 in.), and then upwardly and outwardly into the ledge (90). In some embodiments, the splashguard (82) comprises apertures (83) through which rainwater drains into the gutter.

As shown in FIG. 8, in some embodiments the front wall (80) is relatively short so that a vertical distance d from an upper end of the front wall (80) to the ledge (90) is less than 2.54 cm. (1.0 in.), such as, approximately 1.27 cm. (0.5 in.). It is believed that by keeping the distance d relatively small, the versatility of the present gutter system (5) is enhanced, both in terms of its adaptability to gutters of various shapes and sizes and in terms of its ability to be mounted at various heights and locations to accommodate the existing gutter structure. In addition, the low profile appearance created by keeping the distance d relatively small is believed to add aesthetic appeal to the present gutter cover system (5), once installed.

As further shown in FIG. 8, in some embodiments, the ledge (90) comprises apertures (91) and an upturned lip (92) to keep rainwater from dripping off of the ledge. A return gutter lip-mounting surface (93) may extend rearwardly from the upturned lip (92) a distance slightly greater than the width of the gutter lip (16) and terminate in a downwardly curved, gutter lip-engaging end flange (94). A space (95) between the ledge (90) and the gutter lip-mounting surface allows rainwater to reach the gutter (18). In some embodiments, the ledge (90) is secured to the gutter lip (16) by zip screws (96) or other fasteners. Additional cover sections (not shown) are installed in substantially the same manner as described above to completely cover the gutter (18).

The gutter cover system (5) may be made from a variety of materials. It is desirable to have materials that are light, strong, and flexible. The bracket (10) and cover section (50) can be made of the same materials or each be made of different materials. In some embodiments, the bracket (10) is made of plastic or metal, such as aluminum. In some embodiments, the cover section (50) is made of plastic or metal, such as aluminum. In some embodiments, the bracket (10) is made of plastic and the cover section (50) is made of aluminum.

The gutter cover system (5) may be installed very easily. The bracket (10) is attached to the fascia board of a house or the rear wall of a gutter. It may be attached by a fastener (14), such as a nail, screw, or zip screw. In some embodiments, the bracket (10) may be oriented either way, as shown in FIGS. 1 and 2. The rear edge (70) of the cover section (50) is inserted into the receptacle (12) of the bracket. When the rear edge (70) is inserted far enough, the barb connector (71) will catch in the barb slot (13). The cover section (50) may now be attached to the gutter lip (16). FIGS. 6 and 7 show some embodiments of the gutter cover system (5) after installation.

While the present disclosure has illustrated by description several embodiments and while the illustrative embodiments have been described in considerable detail, it is not the intention of the applicant to restrict or in any way limit the scope of the appended claims to such detail. Additional advantages and modifications may readily appear to those skilled in the art.

What is claimed is:

1. A gutter cover system for a gutter comprising a bracket and a cover section, wherein the bracket comprises an anchoring plate and a receptacle comprising a slot and a barb slot, wherein the barb slot extends from the slot;

wherein the cover section comprises a top portion that extends forwardly from a rear edge of the cover section, a front wall extending downwardly from the top portion, and a ledge extending horizontally in front of the front wall;

wherein the slot engages the rear edge of the cover section; and wherein the rear edge of the cover section comprises a barb connector, wherein the barb connector comprises a flap configured to fold against the top portion of the cover section when the rear edge is inserted within the receptacle, wherein the barb slot engages the flap.

2. The gutter cover system of claim 1, wherein the receptacle has two barb slots.

3. The gutter cover system of claim 1, wherein the anchoring plate is at a 90 degree angle to the receptacle.

4. The gutter cover system of claim 1, wherein the cover section comprises a first longitudinally extending ridge formed in the top portion.

5. The gutter cover system of claim 4, wherein the cover section comprises at least two longitudinally extending ridges.

6. The gutter cover system of claim 1, wherein the cover section comprises apertures.

7. The gutter cover system of claim 4, wherein the cover section comprises a first bank of apertures behind the first longitudinally extending ridge and a second bank of apertures in front of the first longitudinally extending ridge.

8. The gutter cover system of claim 7, wherein an average size of the apertures in the first bank is larger than an average size of the apertures in the second bank.

9. The gutter cover system of claim 1, wherein the bracket is plastic.

10. The gutter cover system of claim 1, wherein the bracket is metal.

11. A method for installing the gutter cover system of claim 1 on the gutter, comprising:

attaching the anchoring plate of the bracket to a fascia board of a house or a rear wall of the gutter; and inserting the rear edge of the cover system into the receptacle until the barb slot engages the flap.

12. The method of claim 11, wherein the receptacle has two barb slots.

13. The method of claim 11, wherein the anchoring plate is at a 90 degree angle to the receptacle.

14. The method of claim 11, wherein the cover section comprises a first longitudinally extending ridge formed in the top portion.

15. The method of claim 14, wherein the cover section comprises at least two longitudinally extending ridges.

16. The method of claim 11, wherein the cover section comprises apertures.

17. The method of claim 14, wherein the cover section comprises a first bank of apertures behind the first longitudinally extending ridge and a second bank of apertures in front of the first longitudinally extending ridge.

18. The method of claim 17, wherein an average size of the apertures in the first bank is larger than an average size of the apertures in the second bank.

19. The method of claim 11, wherein the bracket is plastic.

20. The method of claim 11, wherein the bracket is metal.

* * * * *